United States Patent [19]

Craford et al.

[11] 3,964,039

[45] June 15, 1976

[54] LUMINESCENT SOLID STATE STATUS INDICATORS

[75] Inventors: Magnus George Craford, St. Louis; David Lee Keune, Chesterfield, both of Mo.

[73] Assignee: Monsanto Company, St. Louis, Mo.

[22] Filed: Dec. 24, 1974

[21] Appl. No.: 536,145

[52] U.S. Cl. ..... 340/248 A; 340/248 C; 340/253 A; 324/133

[51] Int. Cl.[2] ..... G08B 21/00

[58] Field of Search ..... 340/80, 248 A, 248 C, 340/252 R, 253 A; 324/133, 102

[56] References Cited

UNITED STATES PATENTS

| | | | |
|---|---|---|---|
| 3,300,659 | 1/1967 | Watters | 340/248 C |
| 3,813,664 | 5/1974 | Geyer | 340/252 R |
| 3,863,150 | 1/1975 | Cebuliak | 324/133 |

*Primary Examiner*—Marshall M. Curtis
*Attorney, Agent, or Firm*—Peter S. Gilster

[57] ABSTRACT

A luminescent solid state status indicator including at least first and second light emitting diodes of different colors which may be mounted on a single header. One side of each of the diodes is connected in common to one side of a source of energizing voltage subject to variation in magnitude. The other sides of the diodes are interconnected with the electrodes of a transistor which has one electrode connected to the other side of the DC energizing voltage. The transistor is adapted selectively to energize the first and second light emitting diodes to display colors corresponding respectively to discrete magnitudes of said energizing voltage.

7 Claims, 2 Drawing Figures

LUMINESCENT SOLID STATE STATUS INDICATORS

BACKGROUND OF THE INVENTION

The present invention relates generally to indicating devices, and more particularly to luminescent solid state status indicators capable of indicating a changing condition such as represented by a change in the magnitude of a signal voltage.

There are many consumer applications including automobiles, household appliances and the like wherein a meter has been replaced with a simple lamp circuit for purposes of economy. A familiar application of such a lamp circuit is as a substitute for the ammeter and oil pressure gauges in the typical automobile instrument panel. While the lamp is capable of indicating a faulty condition, such as battery discharge or dangerously low oil pressure, it cannot indicate a changing condition or, for that matter, the direction from which the change is taking place. Thus, economy has been realized at the sacrifice of the ability to transmit information to the operator of the automobile, appliance or the like.

It is highly desirable to provide a luminescent status indicator which is capable not only of indicating a faulty condition but is also capable of indicating a changing condition, e.g., where represented by a change in the magnitude of a signal voltage. Such a status indicator would not only be valuable in consumer applications but could be used for many measurements in industrial applications where a meter or gauge is presently being employed. In addition, where the preciseness of the measurement provided by a meter or gauge is required, such status indicators could be used in conjunction with the meter or gauge to attract the attention of the operator.

A luminescent solid state status indicator of the foregoing type is disclosed in the co-assigned application of the present inventors, Ser. No. 401,775, filed Sept. 28, 1973, and the luminescent solid state status indicator presently disclosed is an improvement of the indicator disclosed as claimed in the above-described application Ser. No. 401,775, now U.S. Pat. No. 3,873,979 (Craford et al.).

SUMMARY OF THE INVENTION

Among the several objects of the present invention may be noted the provision of an improved luminescent solid state status indicator; the provision of such a solid state status indicator which is capable of providing more useful information than present simple fault indicating lamp circuits; the provision of such a solid state status indicator which may be constructed entirely in integrated form; the provision of such a solid state status indicator which may be constructed in the form of a two-terminal device; then the provision of such a solid state status indicator which is extremely simple, long lasting and reliable in operation.

Briefly, a luminescent solid state status indicator according to the invention includes at least first and second light emitting diodes adapted to emit first and second colors, respectively. Common terminal means connected commonly to one side of both of the light emitting diodes is adapted to be connected to one of a pair of terminals of a source of DC energizing voltage. The energizing voltage may be one of various kinds of signal, e.g., in an automobile, which is subject to variation in magnitude. First terminal means is connected to the other side of the first light emitting diode and second terminal means is connected to the other side of the second light emitting diode. The invention contemplates the improvement comprising a semiconductor current switching device having first, second, and third electrodes, the first electrode being interconnected with the first terminal means, the second electrode being interconnected with the second terminal means, and the third electrode being connected to the other of said pair of terminals of the source of DC energizing voltage. The first and second electrodes are adapted selectively to energize the first and second light emitting diodes corresponding respectively to discrete magnitudes of the energizing voltage thereby to display different colors corresponding to the magnitude of the energizing voltage.

Other objects and features will be in part apparent and in part pointed out hereinafter.

DESCRIPTION OF THE PREFERRED EMBODIMENT

Figure 1:
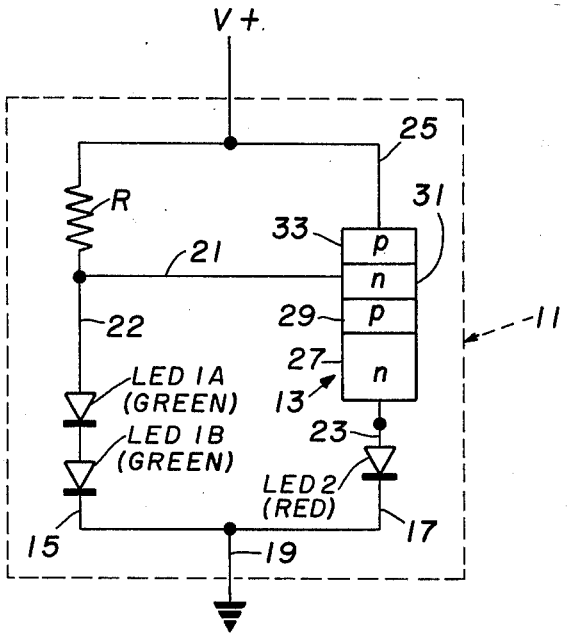
FIG. 1 is a schematic circuit diagram of a preferred embodiment of the invention.

Referring now to the drawing and particularly to FIG. 1, a luminescent solid state status indicator according to the present invention is indicated generally at 11 and briefly includes green light emitting diodes LED 1A and LED 1B, a red light emitting diode LED 2, a silicon programmable unijunction transistor (PUT) indicated generally at 13, and a resistor R. Light emitting diodes of other colors instead be used.

It will be understood that status indicator 11 may be constructed entirely in the form of an integrated circuit constituting a two-terminal device with all elements being located entirely on a single header of suitable conventional type. Thus, transistor 13 may be in the form of a chip mounted on the header.

Alternatively, some of the element of the circuit may be discrete. For example, the light emitting diodes may be generally of the configuration similar to commercially available type MV5491 available from Monsanto Electronics Special Products, Palo Alto, Calif., having a pair of different color light emitting diodes mounted on a single header.

For the present purposes, green light emitting diodes LED 1A and LED 1B may be regarded as a single light emitting diode light source since they are series - connected, for purposes explained hereinbelow. Thus, they have one cathode terminal 15 which is connected commonly to a similar cathode terminal 17 of the red light emitting diode LED 2 to the negative or ground side (constituting a first side) 19 of a source of DC energizing voltage which is subject to variation in magnitude. This energizing voltage, designated V may represent an automotive signal, for example, which is to be monitored for the purpose of detecting a change in its level as a warning.

Transistor 13, which generically is regarded as a semiconductor current switching device is a four-layer p-n-p-n device having a first or gate electrode 21 connected to the anode terminal 22 of green light emitting diodes LED 1A. Switch or transistor 13 also has an anode electrode 23 interconnected with the anode of the red light emitting diode LED 2. A cathode electrode 25 of transistor 13 is interconnected with the positive side of the energizing voltage V+. Resistor R is connected between this positive side of the energizing voltage and the anode of LED 1A.

Transistor 13 is a complementary equivalent of a silicon controlled rectifier (SCR) and is seen to include a body or bulk region 27 of n-type conductivity, a layer 29 of p-type conductivity overlying the bulk region 27, an n-type region 31 overlying region 29, and a p-type region 33 overlying region 31. Such a device exhibits a switching characteristic providing transition from an "off" state during which there is no conduction between the anode 25 and cathode 23 to an "on" state during which conduction may occur between the anode and cathode. This conductive state is attained when a signal of sufficient magnitude is supplied to the gate electrode 21.

Figure 2:
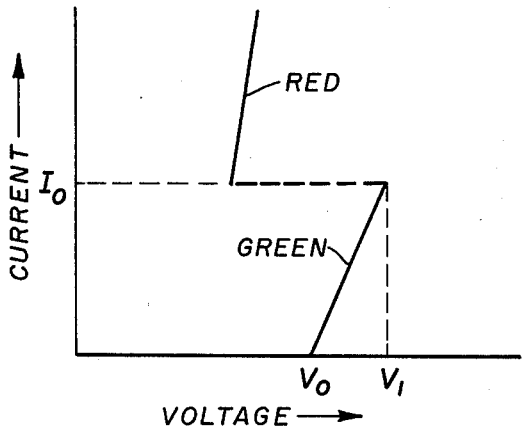
FIG. 2 is a graph illustrating the operation of the circuit shown in FIG. 1.

Referring now to FIG. 2, operation of status indicator 11 is as follows: As the energizing voltage V is increased beyond a first magnitude or an initial value $V_o$, the green light emitting diodes LED 1A and LED 1B begin to emit green light and continue to exhibit green emission of increasing brightness with further increase in voltage until the current into the device exceeds a current $I_o$ associated with preselected voltage magnitude $V_1$. At this point, there is sufficient voltage drop across resistor R to gate transistor 13, causing it to become conductive. When this occurs, current flows through red light emitting diodes LED 2 rather than green light emitting diodes LED 1A and LED 1B because the voltage across the transistor and the red light emitting diode is of lesser magnitude than the voltage across the two series-connected green light emitting diodes. It should be noted that two green light emitting diodes are utilized in the series connection as shown in order to provide a signal of sufficient magnitude at electrode 21 for gating transistor 13. As a result of the foregoing operation, status indicator 11 now emits red light rather than green light. The device continues to provide red light emission as the current increases with further increase in the magnitude of the energizing voltage. Red light emission remains until the current is lowered below the holding value for the transistor. All of the light emitting diodes are then extinguished until the voltage once more attains the value $V_o$.

In view of the foregoing, it will be seen that the various objects of the invention are achieved and other advantages are obtained. Various changes could be made in the construction without departing from the scope of the invention. For example, status indicator 11 may be modified to provide a three-terminal device in which the gate electrode 21 of transistor 13 is provided as a separate terminal in order to provide for switching of the transistor dependent solely upon an external current or voltage applied to such terminal. Accordingly, it is intended that all matters contained in the foregoing description or shown in the accompanying drawings shall be interpreted as illustrative rather than in a limiting sense.

What is claimed is:

1. A luminescent solid state status indicator including at least first and second light emitting diodes adapted to emit first and second colors, respectively, common terminal means connected commonly to one side of both of said light emitting diodes and adapted to be connected to one of a pair of terminals of a source of DC energizing voltage, said energizing voltage being subject to variation in magnitude, first terminal means connected to the other side of the first light emitting diode, second terminal means connected to the other side of the second light emitting diode, wherein the improvement comprises a semiconductor circuit switching device having first, second, and third electrodes, the first electrode being interconnected with the first terminal means, the second electrode being interconnected with the second terminal means, the third electrode being connected to the other of said pair of terminals of the source of DC energizing voltage, said first and second electrodes being adapted selectively to energize the first and second light emitting diodes corresponding respectively to discrete magnitudes of said energizing voltage thereby to display different colors corresponding to the magnitude of said energizing voltage said switching device being operative to cause change from said first color to said second color when said energizing voltage reaches a preselected magnitude.

2. A luminescent solid state status indicator as set forth in claim 1 wherein said first and second light emitting diodes are mounted on a single header.

3. A luminescent solid state status indicator as set forth in claim 1 wherein said semiconductor current switching device comprises a programmable unijunction transistor.

4. A luminescent solid state status indicator as set forth in claim 3 wherein said programmable unijunction transistor comprises a bulk region of n-type electrical conductivity, said bulk region constituting said first electrode, a region of p-type electrical conductivity overlying said n-type bulk region, a region of n-type electrical conductivity overlying said p-type region, the last said n-type region constituting said second electrode, and a region of p-type electrical conductivity overlying the last-said n-type region, the last said p-type region constituting said third electrode, said status indicator further comprising a resistance interconnected between said second terminal means and said third electrode.

5. A luminescent solid state status indicator as set forth in claim 4 wherein said first light emitting diode is a red color type and said second light emitting diode is of green color type, said second light emitting diode being connected in series with a further diode.

6. A luminescent solid state status indicator as set forth in claim 5 wherein said further diode comprises another light emitting diode of green color type.

7. A luminescent solid state status indicator including at least first and second light emitting diodes of first and second colors, respectively, common terminal means connecting one side of each of said diodes to one side of a source of DC energizing voltage, said voltage being subject to variation in magnitude, wherein the improvement comprises a semiconductor current switching device having electrodes interconnected with the other side of each of said diodes and with the other side of said source of DC energizing voltage, said transistor being operative to effect energization of said diodes to cause change of emission from said first color to said second color when said energizing voltage reaches a preselected magnitude, said diodes providing no color emission below a first magnitude of said energizing voltage but providing emission of said first color when said energizing voltage exceeds said first magnitude, said preselected magnitude being greater than said first magnitude.

* * * * *